US008393272B2

(12) United States Patent
Cyr et al.

(10) Patent No.: US 8,393,272 B2
(45) Date of Patent: Mar. 12, 2013

(54) PRINT MEDIA CLEANING SYSTEM AND METHOD

(75) Inventors: Brian C. Cyr, Penfield, NY (US); Jacob Eyngorn, Penfield, NY (US); Gerald R. Curry, Lima, NY (US); Donald R. Fess, Rochester, NY (US); Aaron M. Moore, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 422 days.

(21) Appl. No.: 12/781,511

(22) Filed: May 17, 2010

(65) Prior Publication Data

US 2011/0277652 A1 Nov. 17, 2011

(51) Int. Cl.
*B41F 35/00* (2006.01)

(52) U.S. Cl. ..... 101/425; 101/483

(58) Field of Classification Search ..... 101/425
See application file for complete search history.

(56) References Cited

U.S. PATENT DOCUMENTS 3,626,833 A * 12/1971 Koch ..... 396/608
5,440,379 A * 8/1995 Hayamizu ..... 399/308
6,032,004 A 2/2000 Mirabella, Jr. et al.
6,743,561 B2 6/2004 Heeks et al.
6,782,144 B2 8/2004 Bellavita et al.
6,928,183 B2 8/2005 Mitchell et al.
7,024,150 B2 * 4/2006 Fukuta et al. ..... 399/345
7,291,399 B2 11/2007 Kaplan et al.
7,481,164 B2 * 1/2009 Mori ..... 101/425
8,014,701 B2 * 9/2011 Nakura et al. ..... 399/121
8,042,589 B2 * 10/2011 Hanada ..... 156/389
8,073,363 B2 * 12/2011 Mori ..... 399/165
8,123,421 B2 * 2/2012 Izuchi ..... 400/629
2004/0137203 A1 7/2004 Adams et al.
2005/0220518 A1 10/2005 Priebe
2005/0285918 A1 12/2005 McElligott et al.
2007/0068560 A1 * 3/2007 Shang et al. ..... 134/34
2007/0290053 A1 12/2007 Bov et al.
2010/0079560 A1 4/2010 Derimiggio et al.

* cited by examiner

*Primary Examiner* — Anthony Nguyen
(74) *Attorney, Agent, or Firm* — Gibb & Riley, LLC

(57) ABSTRACT

Disclosed is a system for cleaning a print media sheet and, more particularly, for cleaning a specific portion of sheet that is less than the entire length of the sheet. A device moves a cleaning roller between standby, cleaning fluid receiving and cleaning positions. Timing of cleaning roller movement into the cleaning position is controlled to ensure proper positioning of the cleaning roller with respect to the sheet during cleaning. In the cleaning position, the cleaning roller rotates so as to clean only the specific portion. In the cleaning fluid receiving position, the cleaning roller rotates to receive, from a cleaning fluid dispenser, a predetermined amount of cleaning fluid. Optionally, a retractable shutter can be selectively retracted to expose an opening in a sheet transport path guard and, thereby allow the cleaning roller to move into the cleaning position.

21 Claims, 6 Drawing Sheets

PRINT MEDIA CLEANING SYSTEM AND METHOD

BACKGROUND

Embodiments herein generally relate to electrostatographic image reproduction machines (e.g., electrostatographic printers, copiers or the like) and, more particularly, to embodiments of print media cleaning system and an associated print media cleaning method for use in conjunction with an electrostatographic image reproduction machine.

In electrostatographic image reproduction machines (e.g., electrostatographic printers, copiers or other the like), a toner image is usually fused onto a print media sheet (e.g., a sheet of paper) by a fuser. Specifically, a typical electrostatographic image reproduction machine imparts a toner image onto a print media sheet and then passes the print media sheet through a fuser. The fuser applies heat and pressure in order to fuse (i.e., fix) the toner particles forming the toner image onto the print media sheet. Oftentimes, during this fusing process, toner particles may transfer onto the fuser and, thereby onto other parts of the printer or onto subsequently printed print media sheets. This offset of toner particles can be inhibited or prevented by applying a thin film of fuser oil (e.g., silicon oil) onto the surface of the fuser. Unfortunately, such fuser oil tends to transfer to print media sheets during fusing and can interfere with subsequent finishing processes. For example, fuser oil on the surface of and/or absorbed by a flexible preprinted book cover (i.e., a preprinted book jacket) can prevent adequate glue or tape adhesion during a subsequent book covering and binding process (e.g., a perfect binding process or tape binding process).

SUMMARY

In view of the foregoing disclosed herein are embodiments of a print media cleaning system and an associated print media cleaning method. The embodiments can incorporate a cleaning roller that contacts a portion of a print media sheet passing through a sheet transport path and rotates in order to clean that portion with a cleaning fluid. For example, such a cleaning roller can be used to clean a spine section of a flexible preprinted book cover, after fusing and prior to binding, in order to remove fuser oil from the spine section of the book cover and, thereby to ensure adequate glue or tape adhesion during binding. A positioning device can move the cleaning roller between standby, cleaning fluid receiving and cleaning positions. Timing of cleaning roller movement, particularly into the cleaning position, can be controlled using a leading edge sensor to ensure proper positioning of the cleaning roller with respect to the print media sheet during cleaning. Optionally, a cleaning fluid dispenser can evenly saturate the cleaning roller with a predetermined amount of the cleaning fluid, when the cleaning roller is in the cleaning fluid receiving position. Also, optionally, a retractable shutter can block an opening in a sheet transport path guard, when the cleaning roller is in the standby or cleaning fluid receiving positions, and can retract, as the cleaning roller moves through the opening into the cleaning position.

More particularly, disclosed herein are embodiments of a print media cleaning system. The cleaning system embodiments can comprise at least a leading edge sensor, a moveable cleaning roller and a positioning device for the movable cleaning roller. In each of the embodiments, the leading edge sensor can sense a leading edge of a print media sheet, having a first length, as the print media sheet is transported along a sheet transport path. The positioning device can be operatively connected to the cleaning roller and can be configured such that, a predetermined time period after the leading edge of the print media sheet is sensed by the sensor, it moves the cleaning roller from a standby position to a cleaning position immediately adjacent to the print media sheet. The specific portion can optionally traverse the width of the print media sheet, but has a second length that is less than the first length of the print media sheet.

Once in the cleaning position, the cleaning roller, which has an outside surface covered with an absorbent material essentially evenly saturated with a predetermined amount of cleaning fluid, can traverse the width of the print media sheet and can rotate so as to clean the specific portion of the print media sheet with the cleaning fluid. In one exemplary embodiment, the print media sheet can comprise a flexible preprinted book cover (i.e., a preprinted book jacket) and, when the cleaning roller is in the cleaning position, it can clean the spine section (i.e., the center portion) of that book cover in order to ensure adequate glue or tape adhesion during binding. It should be noted, at the point of contact between the cleaning roller and the print media sheet on a first side of the sheet transport path, the direction of rotation of the cleaning roller should be opposite the direction of travel of the print media sheet along the sheet transport path so as to optimize the cleaning process. When the cleaning process is complete, the positioning device can move the cleaning roller back to the standby position.

The cleaning system can also, optionally, comprise a backer roller that forms a cleaning nip in conjunction with the cleaning roller, when the cleaning roller is in the cleaning position. Specifically, the cleaning roller can be located on the first side of the sheet transport path and the backer roller can be located on a second side of the sheet transport path opposite the first side such that, when the cleaning roller is in the cleaning position, the cleaning roller and the backer roller can form a cleaning nip through which the print media sheet passes. It should be noted that, at the point of contact between the backer roller and the print media sheet on the second side of the sheet transport path, the direction of rotation of the backer roller should be with (i.e., the same as) the direction of travel of the print media sheet in order to inhibit sheet binding as the cleaning roller rotates against the direction of travel of the print media sheet.

An exemplary positioning device that can be incorporated into the cleaning system for moving the cleaning roller can comprise a positioning cam that is fixed to an axle and that has a profile with a notch. The positioning device can further comprise a cam follower having a first end, a second end opposite the first end, and a pivot point between the first end and the second end. A biasing member can be operatively connected to the cam follower at the first end, the positioning cam can be operatively connected to the cam follower adjacent to the biasing member, and the cleaning roller can be operatively connected to the cam follower at the second end. These positioning device components can be configured such that, during rotation of the axle and, thereby during rotation of the positioning cam, the positioning cam engages the first end of the cam follower and causes the cam follower to pivot about the pivot point so as to move the cleaning roller between various positions (e.g., a standby position, a cleaning position and, optionally, a cleaning fluid receiving position, as discussed in greater detail below). These positioning device components can further be configured such that, during rotation of the axle and, thereby during rotation of the cam follower, the biasing member forces the first end of the cam follower against the positioning cam until the notch is aligned vertically above the axle adjacent to the first end of the cam follower and the cleaning roller is in the cleaning position, at which time the biasing member disengages the first end of the cam follower from the positioning cam and forces the cleaning roller against the backer roller.

The cleaning system can also, optionally, comprise a cleaning fluid dispenser. In this case the positioning device can be configured to move the cleaning roller between the standby position, a cleaning fluid receiving position and the cleaning position. Specifically, the positioning device can move the cleaning roller from the standby position to the cleaning fluid receiving position immediately adjacent to the cleaning fluid dispenser. Once in the cleaning fluid receiving position, the cleaning roller can rotate to receive cleaning fluid dispensed by the cleaning fluid dispenser and, particularly, so that the absorbent material covering the outside surface of the cleaning roller is evenly saturated with a predetermined amount of the cleaning fluid. It should be noted that the cleaning roller can be configured to rotate at a first speed in the cleaning fluid receiving position (i.e., a slower speed optimal for receiving the cleaning fluid) and at a second speed greater than the first speed in the cleaning position (i.e., a faster speed optimal for scrubbing the print media sheet). When the cleaning fluid receiving process is complete, the positioning device can move the cleaning roller back to the standby position.

An exemplary cleaning fluid dispenser that can be incorporated into the cleaning system can comprise a cleaning fluid reservoir, a wick and a cleaning fluid metering roller. Specifically, the cleaning fluid reservoir can contain a supply of the cleaning fluid. The wick can be partially submerged in the cleaning fluid and the cleaning fluid metering roller can be fixed to the reservoir and in a positioned immediately adjacent to the exposed surface of the wick such that the wick can transfer the cleaning fluid to the cleaning fluid metering roller. When the cleaning roller is in the cleaning fluid receiving position, the cleaning roller can be positioned immediately adjacent to the cleaning fluid metering roller and can rotate against the cleaning fluid metering roller, thereby causing the cleaning fluid metering roller to rotate and evenly saturate the absorbent material on the cleaning roller with the cleaning fluid. Furthermore, when the cleaning roller is in the cleaning fluid receiving position, the cleaning fluid metering roller can be biased against the cleaning roller and the resulting contact force between them can be selectively adjustable so that the absorbent material on the cleaning roller retains only the predetermined amount of the cleaning fluid.

The cleaning system can also, optionally, comprise a retractable shutter. Specifically, those skilled in the art will recognize that image reproduction machines typically incorporate a sheet transport path guard to guide a print media sheet along a sheet transport path. To accommodate a cleaning system as described herein the sheet transport path guard can comprise an opening to allow the cleaning roller to move into the cleaning position immediately adjacent to the print media sheet. A retractable shutter can block the opening, when the cleaning roller is in any position other than the cleaning position (e.g., in the standby position or optional cleaning fluid receiving position, as described above), and can be retracted (i.e., moved away from the opening) as the cleaning roller moves through the opening into the cleaning position. Shutter retraction can be controlled, for example, using the same positioning device that controls cleaning roller movement. Specifically, the positioning device can essentially simultaneously retract the shutter (i.e., move the shutter away from the opening) and move the cleaning roller into the cleaning position at the opening. Simultaneous movement of the shutter and cleaning roller can be accomplished, for example, if the positioning device further comprises an additional positioning cam fixed to the axle and an additional cam follower operatively connected between the additional positioning cam and the shutter such that, during rotation of the axle as the cleaning roller moves into the cleaning position, the shutter moves away from the opening.

Also disclosed herein are embodiments of an associated print media cleaning method. The method embodiments comprise sensing a leading edge of a print media sheet, having a first length, as the print media sheet is transported along a sheet transport path. Then, a predetermined time period after the leading edge is sensed, a cleaning roller can be moved into to a cleaning position immediately adjacent to the print media sheet. This cleaning roller can comprise an outside surface covered with an absorbent material essentially evenly saturated with a cleaning fluid.

Once the cleaning roller is in the cleaning position, it can be rotated in order to clean a specific portion of the print media sheet with the cleaning fluid. The specific portion can optionally traverse the width of the print media sheet, but has second length that is less than the first length of the print media sheet. In one exemplary embodiment, the print media sheet can comprise a preprinted book cover and the specific portion can comprise the spine section. Rotation of the cleaning fluid saturated cleaning roller against the spine section of the preprinted book cover can be used to remove fuser oil and, thereby to ensure adequate adhesion (e.g., by glue or tape) during a subsequent binding process. The process of rotating the cleaning roller, when it is in the cleaning position, can specifically be performed such that, at the point of contact between the cleaning roller and the print media sheet on a first side of the sheet transport path, the direction of rotation of the cleaning roller is opposite the direction of travel of the print media sheet along the sheet transport path.

The method embodiments can optionally further comprise a number of additional process steps that can be performed when the cleaning roller is in the cleaning position. For example, the cleaning roller can be biased against a rotating backer roller. Specifically, this backer roller can be located on the opposite side (i.e., the second side) of the sheet transport path and positioned directly opposite the cleaning roller, when the cleaning roller is in the cleaning position. Thus, the backer roller and cleaning roller can form a cleaning nip through which the print media sheet passes during the cleaning process. The process of rotating the backer roller, when the cleaning roller is in the cleaning position, can specifically be performed such that, at the point of contact between the backer roller and the print media sheet on the second side of the sheet transport path, the direction of rotation of the backer roller is the same as the direction of travel of the print media sheet.

The method embodiments can optionally further comprise moving the cleaning roller into a cleaning fluid receiving position immediately adjacent to a cleaning fluid dispenser prior to moving it into the cleaning position. Once the cleaning roller is in the cleaning fluid receiving position, it can be rotated so that cleaning fluid dispensed by the dispenser (e.g., through the use of a cleaning fluid metering roller) evenly saturates the absorbent material on the surface of the cleaning roller.

The method embodiments can optionally further comprise a number of additional process steps that can be performed when the cleaning roller is in the cleaning fluid receiving position. For example, the speed at which the cleaning roller is rotated can optionally be selectively controlled so that the cleaning roller rotates at a relatively slow first speed, when the cleaning roller is in the cleaning fluid receiving position, and at a relatively fast second speed, when the cleaning roller is in the cleaning position. Additionally, a contact force between the cleaning roller and the cleaning fluid metering roller can be selectively adjusted to ensure that the absorbent material on the surface of the cleaning roller retains only a predetermined amount of the cleaning fluid.

The method embodiment can also optionally comprise, as the cleaning roller is moved into the cleaning position, essentially simultaneously retracting a shutter from an opening in a sheet transport path guard to allow the cleaning roller to move through the opening and into the cleaning position. Contrarily, as the cleaning roller is moved away from the cleaning position and into either a standby position or cleaning fluid dispensing positioning, the shutter can be moved back into place, blocking the opening.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

Figure 7:
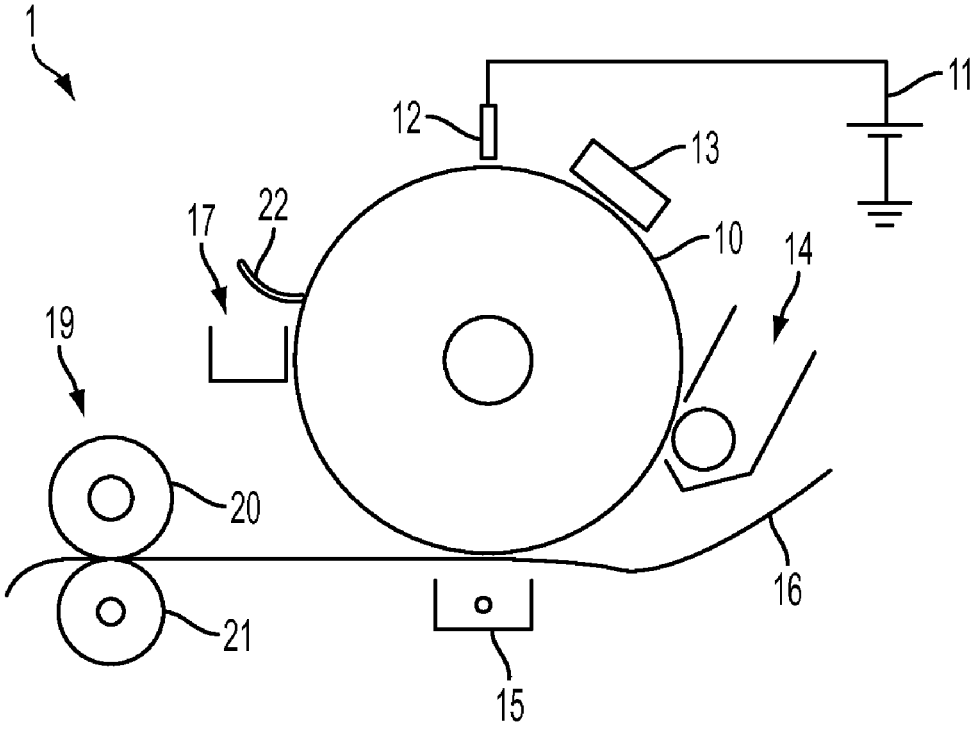
FIG. 7 is a schematic diagram illustrating an exemplary electrostatographic printer.

As discussed above, in electrostatographic image reproduction machines (e.g., electrostatographic printers, copiers or other the like), a toner image is usually fused onto a print media sheet (e.g., a sheet of paper) by a fuser. Specifically, in a typical electrostatographic printer 1, illustrated in FIG. 7 and discussed in detail in U.S. Pat. No. 7,291,399 of Kaplan et al., issued on Nov. 6, 2007, assigned to Xerox Corporation of Norwalk, Conn., USA, a photoreceptor 10 is charged on its surface by means of a charger 12 to which a voltage has been supplied from power supply 11. The photoreceptor 10 is exposed to light from an optical system or an image input apparatus 13, such as a laser and/or light emitting diode, to form an electrostatic latent image thereon. Generally, the electrostatic latent image is developed by bringing a developer mixture of toner particles from developer station 14 into contact with the latent image (e.g., by use of a magnetic brush, powder cloud, or other known development process). After the latent image is developed (i.e., after the toner particles have been deposited onto the photoreceptor forming the toner image), the toner image is transferred from the photoreceptor 10 to a print media sheet 16 by a transfer means 15 that employs, for example, pressure transfer techniques, electrostatic transfer techniques, or the like. Alternatively, the toner image can be transferred from the photoreceptor 10 to an intermediate transfer member (e.g., an image transfer belt) and then subsequently transferred from the intermediate transfer member to the print media sheet 16.

After the toner image is transferred to the print media sheet 16, the photoreceptor 10 rotates through a cleaning station 17, where toner particles left on the photoreceptor 10 are removed by cleaning member 22 (e.g., a blade, brush, or other cleaning apparatus). Additionally, the print media sheet 16 is advanced along a sheet transport path through a fuser 19 (i.e., a fusing station) comprising, for example, fusing and pressure rolls that apply heat and pressure in order to fuse (i.e., fix) the toner particles forming the toner image onto the print medium.

Oftentimes, during this fusing process, toner particles may transfer onto the fuser 19 and, thereby onto other parts of the image reproduction machine or onto subsequently printed print media sheets. This offset of toner particles can be inhibited or prevented by applying a thin film of fuser oil (e.g., silicon oil) onto the surface of the fuser 19. Unfortunately, such fuser oil tends to transfer to print media sheets during fusing and can interfere with subsequent finishing processes. For example, fuser oil on the surface of and/or absorbed by a flexible preprinted book cover (i.e., a preprinted book jacket) can prevent adequate glue or tape adhesion during a subsequent book covering and binding process (e.g., a perfect binding process or tape binding process).

In view of the foregoing disclosed herein are embodiments of a print media cleaning system and an associated method for use in conjunction with an electrostatographic image reproduction machine. The embodiments of the cleaning system can incorporate a cleaning roller that contacts a portion of a print media sheet passing through a sheet transport path and rotates in order to clean that portion with cleaning fluid. For example, such a cleaning roller can be used to clean a spine section of a flexible preprinted book cover, after fusing and prior to binding, in order to remove fuser oil from the spine section of the book cover and, thereby to ensure adequate glue or tape adhesion during binding. A positioning device can move the cleaning roller between standby, cleaning fluid receiving and cleaning positions. Timing of cleaning roller movement, particularly into the cleaning position, can be controlled using a leading edge sensor to ensure proper positioning of the cleaning roller with respect to the print media sheet during cleaning. Optionally, a cleaning fluid dispenser can evenly saturate the cleaning roller with a predetermined amount of the cleaning fluid, when the cleaning roller is in the cleaning fluid receiving position. Also, optionally, a retractable shutter can block an opening in a sheet transport path guard, when the cleaning roller is in the standby or cleaning fluid receiving positions, and can retract, as the cleaning roller moves through the opening into the cleaning position.

Figure 1:
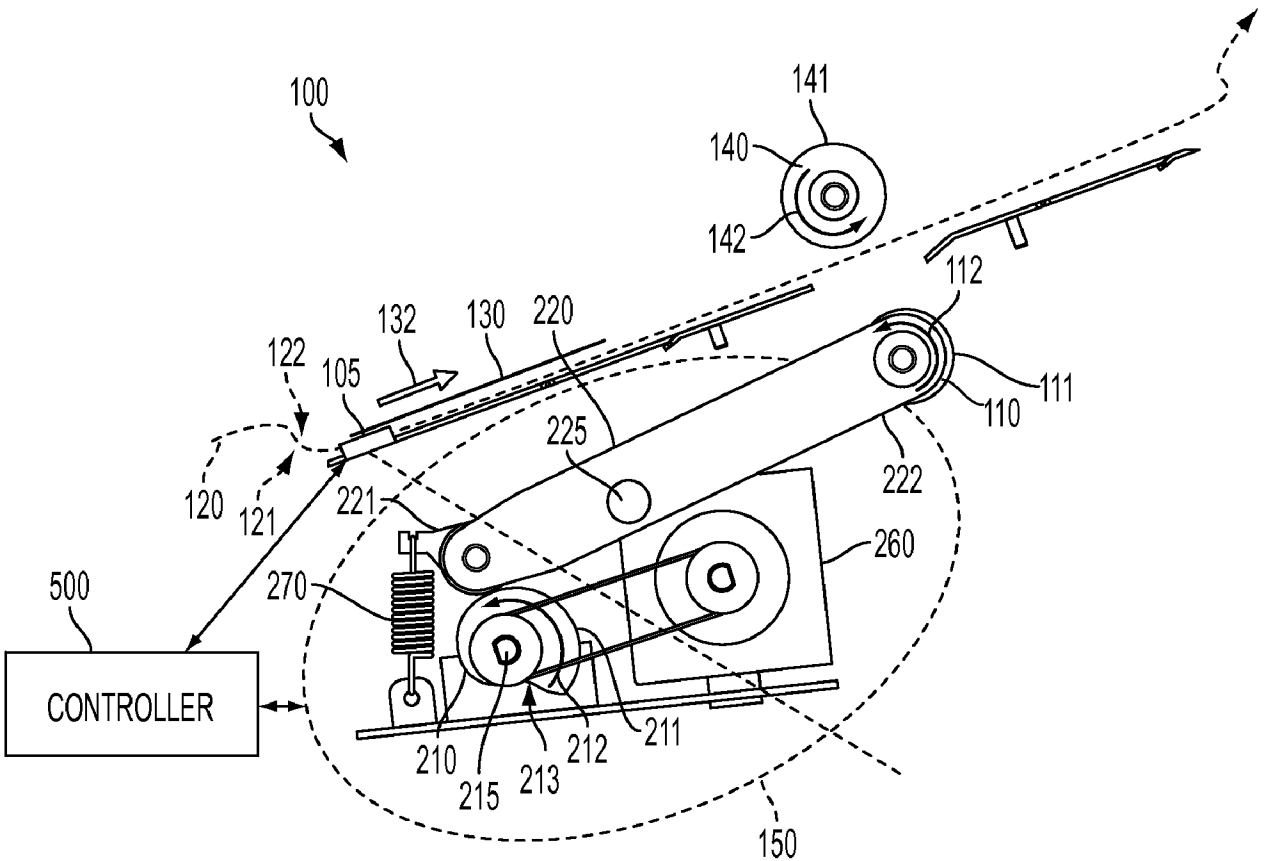
FIG. 1 is a schematic diagram illustrating an embodiment of a print media cleaning system with a cleaning roller set in the standby position.
Figure 2:
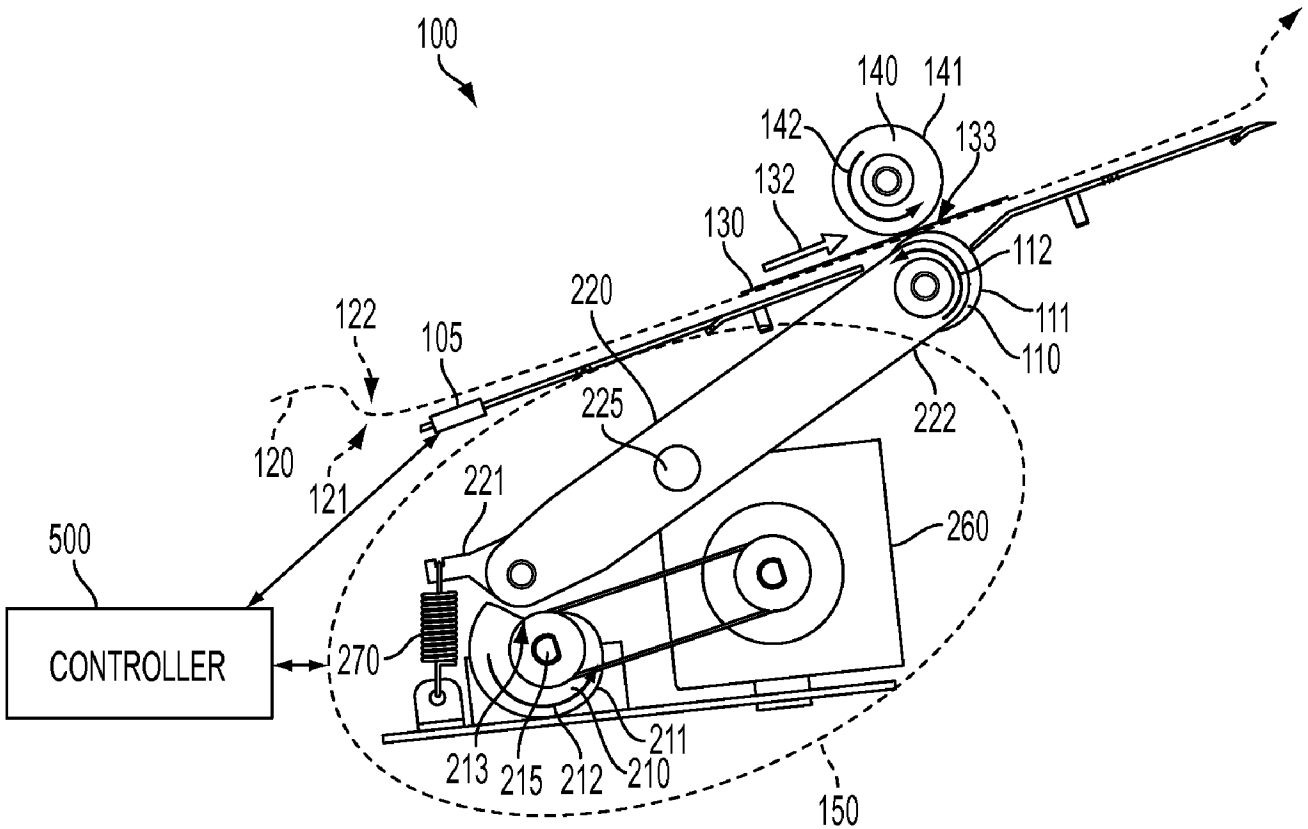
FIG. 2 is a schematic diagram illustrating the print media cleaning system of FIG. 1 with the cleaning roller set in the cleaning position.

More particularly, an embodiment of a print media cleaning system 100 for an image reproduction machine is illustrated in FIGS. 1-2. The cleaning system 100 embodiments can comprise at least a leading edge sensor 105, a moveable cleaning roller 110 (i.e., a movable scrubber roller), a positioning device 150 for the movable cleaning roller 110 and a controller 500.

The cleaning roller 110 can be motorized (i.e., operatively connected to a motor (not shown), which is controlled by the controller 500) and driven so that it rotates in a given direction 112. Motor driven rollers are well-known in the art and, thus, the details are omitted from this specification in order to allow the reader to focus on the salient aspects of the embodiments disclosed. The cleaning roller 110 can optionally be sufficiently long to extend across (i.e., traverse) the width of a print media sheet 130, when in the cleaning position (as discussed in greater detail below) and should have an outside surface 111 covered with an absorbent material (e.g., a cloth material, a sponge or sponge-like material, a foam rubber material, etc.). This absorbent material can be essentially evenly saturated with a predetermined amount of cleaning fluid (i.e., cleaning solution, cleaner, etc.) (see detailed discussion below regarding a cleaning fluid dispenser). The cleaning fluid can be preselected for optimal print media sheet cleaning and may vary depending upon the print media material and the purpose for the cleaning. For example, if the cleaning system 100 is being used to clean spine section of a flexible preprinted book cover to remove fuser oil, such as silicon oil, the cleaning fluid can comprise a surfactant or any other suitable cleaning fluid capable of removing the particular fuser oil without smudging or erasing the printed image or damaging the print media sheet itself. Optionally, this absorbent material can also be textured to enhance the cleaning process.

The leading edge sensor 105 can be in communication with the controller 500 and can sense (i.e., can be adapted to sense, configured to sense, etc.) a leading edge of a print media sheet 130, having a first length, as the print media sheet 130 is transported along a sheet transport path 120. That is, as the print media sheet 130 is transported in a given direction 132 along the sheet transport path 120, the leading edge sensor 105 can detect when that leading edge reaches a particular location. Such leading edge sensors are well-known in the art and, thus, the details are omitted from this specification in order to allow the reader to focus on the salient aspects of the embodiments disclosed.

The positioning device 150 can be controlled by the controller 500 and can be operatively connected to the cleaning roller 110. The positioning device 150 can further move (i.e., can be adapted to move, can be configured to move, etc.) the cleaning roller 110 from a standby position, as shown in FIG. 1, to a cleaning position immediately adjacent to the print media sheet 130, as shown in FIG. 2, a predetermined time period after the leading edge of the print media sheet 130 is sensed by the leading edge sensor 105. In other words, timing of cleaning roller movement into the cleaning position can be controlled, by the controller 500, using the leading edge sensor 105 to ensure proper positioning of the cleaning roller 110 with respect to a portion 133 of the print media sheet 130 requiring cleaning. Those skilled in the art will recognize that the predetermined time period between when the sensor 105 senses the leading edge of the print media sheet 130 and when the controller 500 causes the cleaning roller 110 is moved into the cleaning position will be approximately equal to the time it will take for the portion 133 of the print media sheet 130 to also reach the cleaning position. Thus, this predetermined time period will be dependent upon, for example, the length of the print media sheet 130, the location of the portion 133 on the print media sheet 130, the sheet transport speed, the location of the sensor 105 relative to the cleaning position, etc., and could be, for example, essentially immediately, a given number of seconds, etc.

Once in the cleaning position (as shown in FIG. 2), the cleaning roller 110 can rotate so as to clean (i.e., wipe, scrub, etc.) a specific portion 133 of the print media sheet 130. The cleaning roller 110 can optionally extend across the width of the print media sheet 130 such that the specific portion 133 cleaned traverses the width of the print media sheet. However, due to the selectively controlled timing of cleaning roller movement, the specific portion 133 will have a second length that is less than the first length of the print media sheet. This ensures that only the desired portion 133 is wetted by cleaning fluid and minimizes the likelihood of damage to the print media sheet.

It should be noted that, at the point of contact between the cleaning roller 110 and the print media sheet 130 on a first side 121 of the sheet transport path 120, the direction of rotation 112 of the cleaning roller 110 should be opposite the direction of travel 132 of the print media sheet 130 along the sheet transport path 120 (i.e., against the sheet feed direction) so as to optimize the cleaning process. When the cleaning process is complete, the positioning device 150 can move (i.e., can be adapted to move, configured to move, etc.) the cleaning roller 110 back to the standby position, as shown in FIG. 1. Movement of the cleaning roller 110 back to the standby position can be triggered based, for example, on time, a number of rotations of the cleaning roller, etc.

In one exemplary embodiment, the print media sheet 130 can comprise a flexible preprinted book cover (i.e., a preprinted book jacket) and, when the cleaning roller 110 is in the cleaning position, it can clean the spine section (i.e., the center portion) of that book cover in order to ensure adequate glue or tape adhesion during subsequent binding (e.g., a perfect bound binding process).

Referring to FIG. 2, the cleaning system 100 can also, optionally, comprise a backer roller 140 that forms a cleaning nip in conjunction with the cleaning roller 110 when the cleaning roller 110 is in the cleaning position, as shown in FIG. 2. Specifically, the cleaning roller 110 can be located on a first side 121 of the sheet transport path 120 and the backer roller 140 can be located on a second side 122 of the sheet transport path 120 opposite the first side 121 such that, when the cleaning roller 110 is in the cleaning position, the cleaning roller 110 and the backer roller 140 form a cleaning nip through which the print media sheet 130 passes.

The backer roller 140 can, optionally, comprise a compliant, soft, outer surface 141 (e.g., a foam rubber outer surface) that, when the cleaning roller 110 is in the cleaning position, inhibits bouncing of the cleaning roller 110 away from the print media sheet 130 and equalizes pressure exerted by the cleaning roller 110 across the width of the print media sheet 130 in order to further optimize the cleaning process.

The backer roller 140 can also, optionally, be motorized (i.e., operatively connected to a motor (not shown)) and driven so that it rotates in a given direction 142. It should be noted that, at the point of contact between the backer roller 140 and the print media sheet 130 on the second side 122 of the sheet transport path 120, the direction of rotation 142 of the backer roller 140 should be with (i.e., the same as) the direction of travel 132 of the print media sheet 130 (i.e., in the sheet feed direction) in order to inhibit sheet binding as the cleaning roller 110 rotates against the direction of travel 132 of the print media sheet 130. It should be noted that, in this case, the directions of rotation of the cleaning roller 110 and backer roller 140 will actually be the same because these rollers 110, 140 are located on opposite sides of the sheet transport path 120. Furthermore, it should be noted that adding an additional motor for rotating the backer roller 140 can be avoided by using gears to tie rotation of the backer roller 140 into the existing drive system (i.e., into the drive system responsible for transporting the print media sheet 130 along the sheet transport path 120). For example, since drive rollers for a sheet transport drive system are typically located on the lower side (i.e., the first side) of the sheet transport path 120, gears connected between the drive system and the backer roller 140 can be used to reverse the rotational direction of the drives causing the backer roller 140 to rotate in the correct direction.

Referring again to FIGS. 1 and 2, an exemplary positioning device 150 that can be incorporated into the cleaning system 100 for moving the cleaning roller 110, as described above, can comprise a positioning cam 210 fixed to a positioning axle 215 and having a profile 211 (e.g., an essential oval-shaped profile) with a notch 213. The positioning device 150 can further comprise an elongated cam follower 220 having a first end 221, a second end 222 opposite the first end 221, and a pivot point 225 (i.e., an axis about which the cam follower 220 pivots) between the first end 221 and the second end 222. A biasing member 270 (e.g., a spring (as illustrated), a resilient flexible material, etc.) can be operatively connected to the cam follower 220 at the first end 221. The positioning cam 210 can be operatively connected to the cam follower 220 adjacent to the biasing member 270 and the cleaning roller 110 can be operatively connected to the cam follower 220 at the second end 222. Additionally, the positioning axle 215 can be motorized (i.e., operatively connected to a motor 260, which is controlled by the controller 500) and driven so that it rotates and, thereby rotates the positioning cam 210 in a given direction 212.

These positioning device components can be configured such that, during rotation of the positioning axle 215 and, thereby during rotation of the positioning cam 210, the positioning cam 210 engages the first end 221 of the cam follower 220 and the profile 211 of the positioning cam 210 causes the cam follower 220 to pivot about the pivot point 225. This, in turn, raises and lowers the second end 222 so as to move the cleaning roller 110 between various positions (e.g., a standby position (as shown in FIG. 1), a cleaning position (as shown in FIG. 2) and, optionally, a cleaning fluid receiving position (as shown in FIG. 3 and discussed in greater detail below)).

These positioning device components can further be configured such that, during rotation of the positioning axle 215 and, thereby during rotation of the positioning cam 210, the biasing member 270 biases (i.e., forces) the first end 221 of the cam follower 220 against the positioning cam 210 until the notch 213 is aligned vertically above the positioning axle 215 adjacent to the first end 221 of the cam follower 220 and the cleaning roller 110 is in the cleaning position, at which time the biasing member 270 disengages the first end 221 of the cam follower 220 from the positioning cam 210 and biases (i.e., forces) the cleaning roller 110 against the backer roller 140. Biasing the cleaning roller 110 against the backer roller 140 in this manner, when the cleaning roller 110 is in the cleaning position, ensures that a consistent force is applied by the cleaning roller 110 against the print media sheet 130 and inhibits sheet binding as the cleaning roller 110 rotates against direction of travel 132 of the print media sheet 130.

Figure 3:
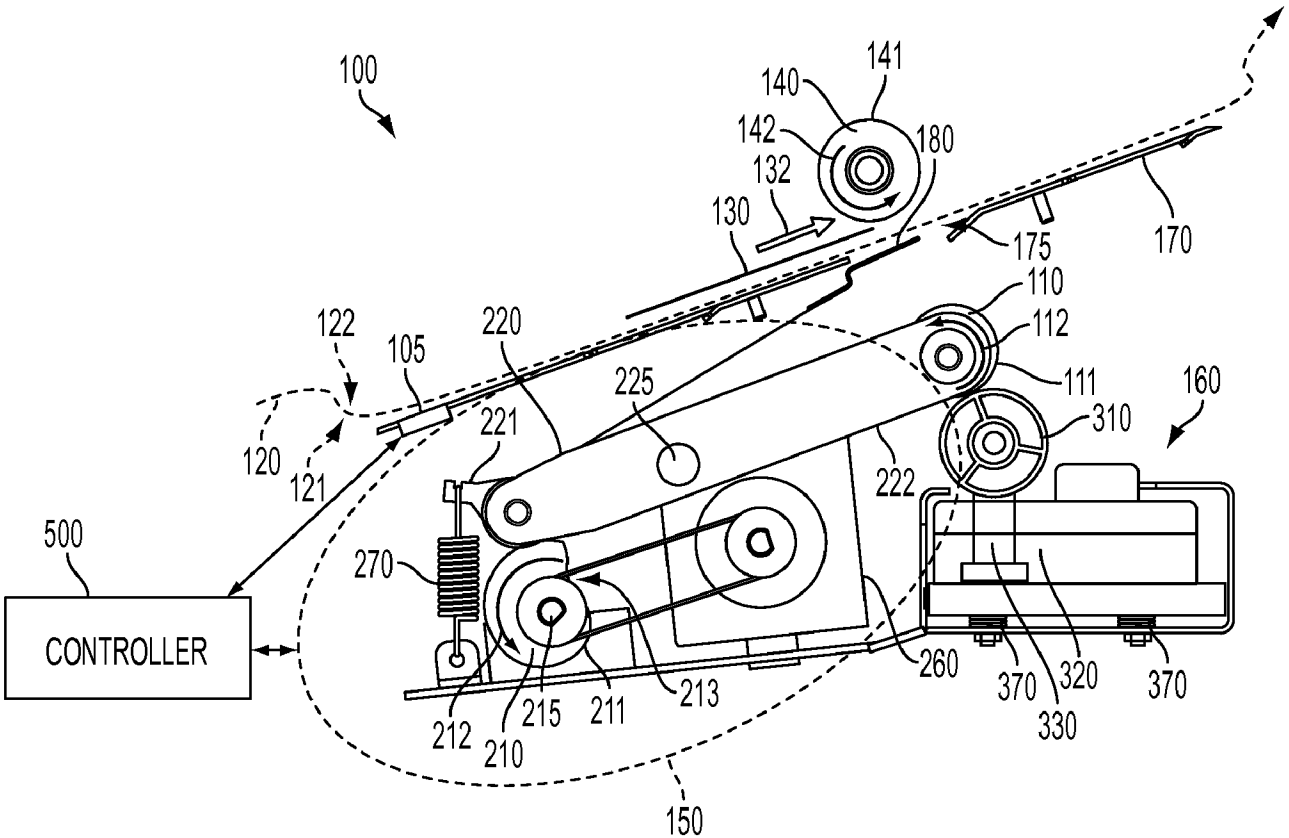
FIG. 3 is a schematic diagram illustrating the print media cleaning system of FIG. 1 with the cleaning roller set in a cleaning fluid receiving position adjacent to an optional cleaning fluid dispenser and also with an optional retractable shutter.

Referring to FIG. 3, the cleaning system 100 can also, optionally, comprise a cleaning fluid dispenser 160. In this case, the positioning device 150 can be configured to move the cleaning roller 110 between the standby position (as shown in FIG. 1), a cleaning fluid receiving position (as shown in FIG. 3) and the cleaning position (as shown in FIG. 2). Specifically, the positioning device components, as described above, can be configured to move the cleaning roller 110 from the standby position to the cleaning fluid receiving position, as shown in FIG. 3, immediately adjacent to the cleaning fluid dispenser 160. Timing of cleaning roller movement into the cleaning fluid receiving position can be triggered, for example, at the beginning of a printing process, when a leading edge of a print media sheet is detected, after a predetermined number of print media sheets are cleaned, anytime a moisture detector (not shown) senses additional cleaning fluid is required, etc.

Once in the cleaning fluid receiving position, the cleaning roller 110 can rotate to receive cleaning fluid dispensed by the cleaning fluid dispenser 160 and, particularly, so that the absorbent material covering the outside surface 111 of the cleaning roller 110 is evenly (i.e., uniformly) saturated with a predetermined amount of the cleaning fluid. It should be noted that the motor driving rotation of the cleaning roller 110 can be an adjustable speed motor so as to allow the cleaning roller 110 to rotate at a first speed in the cleaning fluid receiving position (i.e., a slower speed optimal for receiving and absorbing the cleaning fluid and for preventing splashing) and at a second speed greater than the first speed in the cleaning position (i.e., a faster speed optimal for scrubbing the print media sheet). When the cleaning fluid receiving process is complete, the positioning device 150 can move the cleaning roller 110 back to the standby position (as shown in FIG. 1). Then, as discussed above, a predetermined time period after the leading edge of the print media sheet 130 is sensed by the leading edge sensor 105, the positioning device 150 can move the cleaning roller 110 from the standby position to the cleaning position (see FIG. 2), where it can rotate so as to clean the specific portion 133 of the print media sheet 130.

Figure 4:
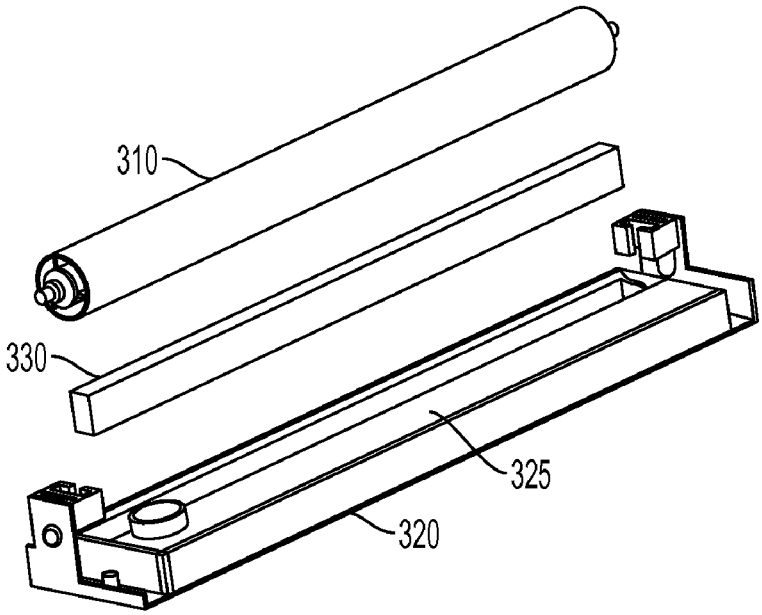
FIG. 4 is a schematic diagram illustrating an exploded view of an exemplary cleaning fluid dispenser that can be incorporated in the cleaning system embodiments.

Referring to FIG. 3 in combination with FIG. 4, an exemplary cleaning fluid dispenser 160 that can be incorporated into the cleaning system 100 can comprise an elongated cleaning fluid reservoir 320, a wick 330 and a cleaning fluid metering roller 310.

Specifically, the cleaning fluid reservoir 320 (i.e., a container) can contain a refillable supply of a cleaning fluid 325 (i.e., cleaning solution, cleaner, etc.). As mentioned above, this cleaning fluid 325 can be preselected for optimal print media sheet cleaning and may vary depending upon the print media material and the purpose for the cleaning. The wick 330 can be partially submerged (i.e., partially immersed) in the cleaning fluid 325 such that a lower portion of the wick 330 sits within the cleaning fluid 325 and an upper portion of the wick 330 is exposed above the cleaning fluid 325. The cleaning fluid metering roller 310 can be fixed to the reservoir 320 and located in positioned immediately adjacent to (i.e., in contact with) the exposed top surface of the wick 330 (i.e., adjacent to the upper portion of the wick 330). The wick 330 can comprise one or more materials suitable for drawing up the cleaning fluid 325 from the reservoir 320 and transferring to the cleaning fluid metering roller 310. For example, the wick 330 can comprise an absorbent man-made or natural non-woven material (e.g., felt), an absorbent man-made or natural porous material (e.g., sponge); etc. Rotation of the cleaning fluid metering roller 310 can be passive (i.e., not motorized). Consequently, when the cleaning roller 110 is in the cleaning fluid receiving position, the cleaning roller 110 can contact the cleaning fluid metering roller 310 and can rotate, thereby causing the cleaning fluid metering roller 310 to rotate. Rotation of the cleaning roller 110 against the cleaning fluid metering roller 310 ensure that the absorbent material on the surface 111 of cleaning roller 110 is evenly saturated with the cleaning fluid 325. It should be noted that the cleaning roller 110, cleaning fluid metering roller 310, wick 330 and cleaning fluid reservoir 320 should be arranged in parallel and should all have approximately the same length to ensure adequate cleaning fluid transfer from the reservoir 320 up to the cleaning roller 110.

Optionally, the cleaning fluid dispenser 160 and, particularly, the cleaning fluid metering roller 310 can be biased against the cleaning roller 110, when the cleaning roller 110 is in the cleaning fluid receiving position (as shown in FIG. 3), and the resulting contact force between the cleaning fluid metering roller 310 and the cleaning roller 110 can be selectively adjustable so that the absorbent material on the surface 111 of the cleaning roller 110 retains only the predetermined amount of the cleaning fluid 325. In other words, having a selectively adjustable contact force between the cleaning roller 110 and the cleaning fluid metering roller 310 allows the cleaning fluid dispenser 160 to selectively vary the amount of cleaning fluid 325 received and absorbed by the cleaning roller 110.

For example, biasing members 370 (e.g., springs, pistons, etc.) can be operatively connected to a bottom surface of the cleaning fluid reservoir 320 so as to apply an essentially uniform and consistent biasing force, via the metering roller 310 (which is fixed the reservoir 320), against the cleaning roller 110. The resulting contact force between the cleaning fluid metering roller 310 and the cleaning roller 110 can be selectively adjusted, however, by selecting between multiple different cleaning fluid receiving positions. For example, a first cleaning fluid receiving position, in which the axles of the cleaning and cleaning fluid metering rollers are relatively close provides for a relatively high contact force and, thereby lessens the amount of cleaning fluid retained by the cleaning roller 110, whereas a second cleaning fluid receiving position in which the axles of the cleaning and cleaning fluid metering rollers 110, 310 are relatively far apart provides for a relatively low contact force and, thereby increases the amount of cleaning fluid retained by the cleaning roller 110. Such different cleaning fluid receiving positions can be accomplished, for example, if the motor 260 controlling rotation of the positioning axle 215 and, thereby controlling rotation of the positioning cam 210 and movement of the cleaning roller 110 comprises a stepper-motor. Thus, the disclosed cleaning fluid dispenser can deliver a specific and repeatable amount of cleaning fluid 325 to the cleaning roller 110 in a short period of time.

It should be noted that such a cleaning fluid dispenser 160 can be removable so that the cleaning fluid reservoir 320 can be easily refilled with the cleaning fluid, as necessary.

Figure 5:
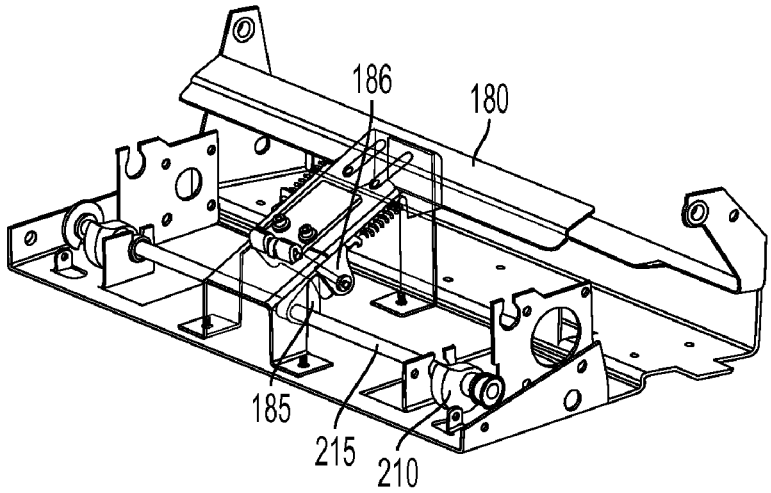
FIG. 5 is a schematic diagram illustrating an exemplary retractable shutter that can be incorporated into the cleaning system embodiments.

Referring to FIG. 5, the cleaning system 100 can also, optionally, comprise a retractable shutter 180. Specifically, those skilled in the art will recognize that image reproduction machines typically incorporate a sheet transport path guard 170 (i.e., a baffle) to guide a print media sheet 130 along a sheet transport path 120. Such a guard 170 can support drive rollers for sheet transport devices and can inhibit the occurrence of sheet jams. To accommodate a cleaning system as described herein the sheet transport path guard 170 can comprise an opening 175 (i.e., a cut-out) to allow the cleaning roller 110 to move into the cleaning position immediately adjacent to the print media sheet 130. This opening 175 can be sufficient in width to accommodate the diameter of the cleaning roller 110 (e.g., approximately 1 inch) and sufficient in length to accommodate the length of the cleaning roller 110 so as to allow the cleaning roller 110 to pass through the opening 175 and, if necessary, can extend across the width of the print media sheet 130.

In order to prevent jams as a result of print media sheets passing through the opening, a retractable shutter 180 can block the opening 175 when the cleaning roller 110 is in any position other than the cleaning position (e.g., in the standby position or optional cleaning fluid receiving position, as described above) and can be retracted (i.e., moved away from the opening) when the cleaning roller 110 is in the cleaning position. Shutter 180 retraction can be, for example, spring-loaded. Alternatively, shutter 180 retraction can be controlled, for example, using the same positioning device 150 that controls cleaning roller 110 movement such that the positioning device 150 essentially simultaneously retracts the shutter 180 (i.e., move the shutter 180 away from the opening 175) and moves the cleaning roller 110 into the cleaning position at the opening 175. Thus, no additional motors or controller programming would be required to operate the shutter 180.

Referring to FIG. 5 in combination with FIG. 3, simultaneous movement of the shutter 180 and cleaning roller 110 can be accomplished, for example, if the positioning device 150 further comprises a shutter positioning cam 185 (i.e., an additional positioning cam) and a shutter cam follower 186 (i.e., an additional cam follower) operatively connected between the shutter 180 and the shutter positioning cam 185. Specifically, the shutter positioning cam 185 can be fixed to the same positioning axle 215 to which the cleaning roller positioning cam 210 is fixed. The shutter positioning cam 185 and shutter cam follower 186 can further be configured such that, during rotation of the positioning axle 215 as the cleaning roller 110 moves into the cleaning position, the shutter positioning cam 185 rotates and pushes against the shutter cam follower 186, thereby causing the shutter 180 to retract (i.e., to move away from the opening 175. As discussed above, when the cleaning roller 110 is in cleaning position (see FIG. 2), it can rotate so as to clean the specific portion 133 of the print media sheet 130.

It should be understood that the term "controller" as used herein comprises a computerized device adapted to perform (i.e., programmed to perform, configured to perform, etc.) the above described system operations (e.g., controlling cleaning roller movement, controlling cleaning roller rotation, etc.). Preferably this controller comprises a programmable, self-contained, dedicated mini-computer having a central processor unit (CPU), electronic storage, and a display or user interface (UI) and can function as the main control system for either a stand-alone document production system or multiple modules (e.g., the feeder module(s), stacker module(s), interface modules(s) printing module(s), cleaning modules, binding modules, etc.) within a modular document production system. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted here from to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

It should further be understood that the cleaning system 100 can be integrated into a stand-alone document production system, for example, along a sheet transport path between a fuser and binder or other type of finisher. Alternatively, in a modular document production system, this cleaning system 100 can be integrated into an existing module (e.g., a binding or other type of finishing module) or can be configured as completely discrete module.

Figure 6:
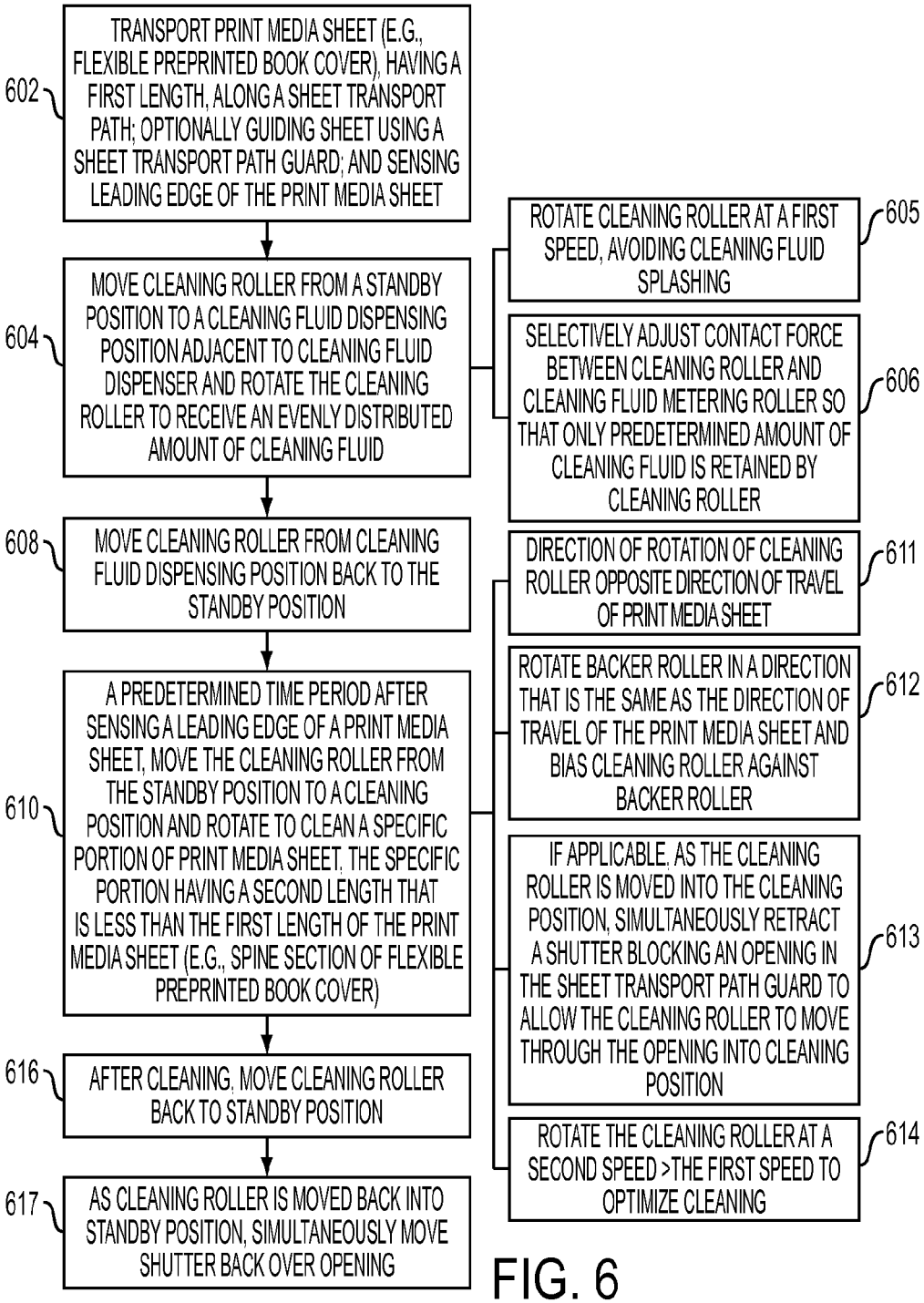
FIG. 6 is a flow diagram illustrating an embodiment of a print media cleaning method.

Referring to FIG. 6 in combination with FIGS. 1-3, also disclosed herein are embodiments of a print media cleaning method associated with the print media cleaning system 100, as discussed in detail above. The method embodiments comprise transporting (e.g., by one or more sheet transport devices) a print media sheet 130 along a sheet transport path 120 (602). During this process 602, the print media sheet 130 can optionally be guided by a sheet transport path guard 170. Next, the method embodiments can comprise sensing (e.g., by a sensor 105) a leading edge of the print media sheet 130 as it is transported along the sheet transport path 120.

Then, a predetermined time period after the leading edge is sensed, a cleaning roller 110 can be moved (e.g., by a positioning device 150) from a standby position (as shown in FIG. 1) into to a cleaning position immediately adjacent to a specific portion 133 of the print media sheet 130 such that it traverses a width of the print media sheet 130 (610, as shown in FIG. 2). This cleaning roller 110 can comprise an outside surface 111 covered with an absorbent material essentially evenly saturated with a cleaning fluid.

Once the cleaning roller 110 is in the cleaning position, it can be rotated (e.g., by a motor) in order to clean the specific portion 133 of the print media sheet 130 with the cleaning fluid (610). In one exemplary embodiment, the print media sheet 130 can comprise a preprinted book cover and the specific portion 133 can comprise the spine section of that book cover. Rotation of the cleaning fluid saturated cleaning roller 110 against the spine section of the preprinted book cover can be used to remove fuser oil (e.g., silicon oil) and, thereby to ensure adequate adhesion (e.g., by glue or tape) during a subsequent binding process.

The process of rotating the cleaning roller 110, when it is in the cleaning position, can specifically comprise rotating it such that, at the point of contact between the cleaning roller 110 and the print media sheet 130 on a first side 121 of the sheet transport path 120, the direction of rotation 112 of the cleaning roller 110 is opposite the direction of travel 132 of the print media sheet 130 along the sheet transport path 120 (611). This is to optimize the cleaning process.

The method can further optionally comprise a number of additional process steps performed when the cleaning roller 110 is in the cleaning position. For example, the cleaning roller 110 can be biased (e.g., by a biasing member, such as a spring, piston, flexible member, etc.) against a rotating backer roller 140 (612). Specifically, this backer roller 140 can be located on the opposite side (i.e., the second side 122) of the sheet transport path 120 and positioned directly opposite the cleaning roller 110, when the cleaning roller 110 is in the cleaning position. Thus, the backer roller 140 and cleaning roller 110 can form a cleaning nip through which the print media sheet 130 passes during the cleaning process. The process of rotating the backer roller 140 can be performed, for example, by a motor, specifically so that, at the point of contact between the backer roller 140 and the print media sheet 130 on the second side 122 of the sheet transport path 120, the direction of rotation 142 of the backer roller 140 is the same as the direction of travel 132 of the print media sheet 130. This inhibits sheet binding as the cleaning roller 110 rotates against the direction of travel 132 of the print media sheet 130. Additionally, biasing the cleaning roller 110 against this rotating backer roller 140 ensures that a consistent force is applied by the cleaning roller 110 across the width of the print media sheet 130 as it passes through the cleaning nip. Such biasing also further inhibits sheet binding as the cleaning roller 110 rotates against direction of travel 132 of the print media sheet 130.

The method embodiments can further optionally comprise moving the cleaning roller 110 (e.g., by the positioning device 150) from the standby position into a cleaning fluid receiving position immediately adjacent to a cleaning fluid dispenser 160 prior to moving it into the cleaning position at process 610 (604, as shown in FIG. 3). The method can further optionally comprise a number of additional process steps performed when the cleaning roller 110 is in the cleaning fluid receiving position. For example, the cleaning roller 110 can be rotated (e.g., by the motor) so that cleaning fluid dispensed by the dispenser 160 (e.g., through the use of a cleaning fluid metering roller 310) can evenly saturate the absorbent material on the surface 111 of the cleaning roller 110.

It should be noted that the speed at which the cleaning roller 110 is rotated can optionally be selectively adjust (e.g., through the use of a stepper motor) so that it when the speed of rotation when the cleaning roller is in the cleaning fluid is different from the speed of rotation when the cleaning roller is in the cleaning fluid receiving position. For example, in the cleaning fluid receiving position, the cleaning roller 110 can be rotated at a relatively slow first speed to prevent splashing of the cleaning fluid (605), whereas in the cleaning position, the cleaning roller 110 can be rotated at a relatively fast section speed to enhance the cleaning process (614). Additionally, a contact force between the cleaning roller 110 and the cleaning fluid metering roller 310 can be selectively adjusted (as discussed in detail with regard to the system embodiments) to ensure that the absorbent material on the surface of the cleaning roller 110 retains only a predetermined amount of the cleaning fluid (606). For example, if the contact force is adjusted so that it is relatively high, less cleaning fluid will be retained by the absorbent material, whereas if the contact force is adjusted so that it is relatively low, more cleaning fluid will be retained by the absorbent material.

Finally, the method embodiment can optionally comprise operating a retractable shutter 180 so that it either blocks or exposes an opening 175 in a sheet transport path guard 170 (see FIG. 3), depending upon the movement of the cleaning roller 110. Specifically, as the cleaning roller 110 is moved into the cleaning position at process 610, the retractable shutter 180 can be essentially simultaneously retracted from (i.e., moved away from) the opening 175 so that the cleaning roller 110 can move through the opening 175 and into the cleaning position (613). Furthermore, as the cleaning roller 110 is moved away from the cleaning position and into either the standby position or the cleaning fluid dispensing positioning, the retractable shutter 180 can be moved back into place, blocking the opening 175 (617). Such a shutter 180 is used to avoid sheet jams when the cleaning process is not being performed.

Also disclosed herein are embodiments of a computer program product. This computer program product can comprise a computer usable medium. The computer useable medium can have computer useable program code embodied therewith, which can be configured to perform the above-described method for cleaning a print media sheet. This computer program product can comprise a tangible computer-usable (i.e., computer-readable) medium on which a computer-useable (i.e., computer-readable) program code (i.e., a control program, a set of executable instructions, etc.) is recorded or embodied. Tangible computer-usable media can, for example, a memory device on which the program is recorded or, alternatively, can comprise a transmittable carrier wave in which the program is embodied as a data signal. Exemplary forms of tangible computer-usable media include, but are not limited to, floppy disks, flexible disks, hard disks, magnetic tape, any other magnetic storage medium, CD-ROM, DVD, any other optical medium, a RAM, a PROM, an EPROM, a FLASH-EPROM, any other memory chip or cartridge, transmission media (e.g., acoustic or light waves generated during radio wave or infrared data communications, respectively) or any other medium from which a computer can read and use program code. In this case, the computer-usable program code can be specifically configured to perform the above-described print media cleaning method. That is, the computer-usable program code can be read by and executed by a computer, for example, the above described controller 500, in order to perform the above-described method.

For illustration purposes, the embodiments of the present invention are described for use in conjunction with removing fuser oil (e.g., silicon oil) from the spine section of a flexible preprinted book cover after a toner image has been fused onto the book cover and prior to binding a book using the book cover (e.g., in a perfect or tape binding process) in order to ensure proper adhesion. However, it is anticipated these embodiments could, additionally or alternatively, be used at any other point in a document production process where sheet cleaning might be deemed necessary.

The should also be understood that the terms "image reproduction machine", "printer", "copier", "image output terminal", etc. as used herein encompass any apparatus, such as a printing device, digital copier, bookmaking machine, facsimile machine, multi-function machine, etc. which performs a print outputting function for any purpose. The details of printers, printing engines, etc. are well-known by those ordinarily skilled in the art and are discussed in, for example, U.S. Pat. No. 6,032,004, the complete disclosure of which is fully incorporated herein by reference. The embodiments herein can encompass embodiments that print in color, monochrome, or handle color or monochrome image data. All foregoing embodiments are specifically applicable to electrostatographic and/or xerographic machines and/or processes.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein should not be implied or imported from any above example as limitations to any particular order, number, position, size, shape, angle, color, or material.

Therefore, disclosed above are embodiments of a print media cleaning system and an associated print media cleaning method for use in conjunction with an electrostatographic image reproduction machine. The embodiments of the cleaning system can incorporate a cleaning roller that contacts a portion of a print media sheet passing through a sheet transport path and rotates in order to clean that portion. For example, such a cleaning roller can be used to clean a center portion of a flexible preprinted book cover, after fusing and prior to binding, in order to remove fuser oil from the spine section of the book cover and, thereby to ensure adequate glue or tape adhesion during binding. A positioning device can move the cleaning roller between standby, cleaning fluid receiving and cleaning positions. Timing of cleaning roller movement, particularly into the cleaning position, can be controlled using a leading edge sensor to ensure proper positioning of the cleaning roller with respect to the print media sheet during cleaning. Optionally, a cleaning fluid dispenser can evenly saturate the cleaning roller with a predetermined amount of cleaning fluid, when the cleaning roller is in the cleaning fluid receiving position. Also, optionally, a retractable shutter can block an opening in a sheet transport path guard, when the cleaning roller is in the standby or cleaning fluid receiving positions, and can retract, as the cleaning roller moves through the opening into the cleaning position.

What is claimed is:

1. A print media cleaning system comprising:

a sensor sensing a leading edge of a print media sheet, having a first length, as said print media sheet is transported along a sheet transport path;

a movable cleaning roller comprising an outside surface covered with an absorbent material, said absorbent material being essentially evenly saturated with a cleaning fluid; and a positioning device operatively connected to said cleaning roller, a predetermined time period after said leading edge is sensed by said sensor, said positioning device moving said cleaning roller to a cleaning position in contact with said print media sheet, and when in said cleaning position, said cleaning roller rotating so as to clean a specific portion of said print media sheet with said cleaning fluid, said specific portion having a second length that is less than said first length.

2. The cleaning system of claim 1, said print media sheet comprising a preprinted book cover and said specified portion comprising a spine section of said preprinted book cover, wherein cleaning, by said cleaning roller of said spine section, removes fuser oil and ensures adequate adhesion during subsequent binding.

3. The cleaning system of claim 1, said cleaning roller being located on a first side of said sheet transport path, wherein, at a point of contact between said cleaning roller and said print media sheet on said first side, a direction of rotation of said cleaning roller is opposite a direction of travel of said print media sheet along said sheet transport path, and said cleaning system further comprising a backer roller located on a second side of said sheet transport path opposite said first side such that, when said cleaning roller is in said cleaning position, said cleaning roller and said backer roller form a cleaning nip through which said print media sheet passes, wherein, at a point of contact between said backer roller and said print media sheet on said second side, a direction of rotation of said backer roller is the same as said direction of travel of said print media sheet.

4. The cleaning system of claim 3 said positioning device comprising:

a cam follower having a first end, a second end opposite said first end, and a pivot point between said first end and said second end, wherein said cleaning roller is operatively connected to said cam follower at said second end;

a biasing member operatively connected to said cam follower at said first end;

an axle; and a positioning cam fixed to said axle and operatively connected to said cam follower adjacent to said biasing member, said positioning cam having a profile with a notch, during rotation of said axle, said profile of said positioning cam causing said cam follower to pivot about said pivot point moving said cleaning roller, and during rotation of said axle, said biasing member forcing said first end of said cam follower against said positioning cam until said notch is positioned above said axle adjacent to said first end and said cleaning roller is in said cleaning position and, when said notch is above said axle and said cleaning roller is in said cleaning position, said biasing member disengaging said first end of said cam follower from said positioning cam and forcing said cleaning roller against said backer roller.

5. The cleaning system of claim 1, further comprising a cleaning fluid dispenser, before moving said cleaning roller into said cleaning position, said positioning device moving said cleaning roller to a cleaning fluid receiving position immediately adjacent to said cleaning fluid dispenser, and when in said cleaning fluid receiving position, said cleaning roller rotating so that cleaning fluid dispensed by said cleaning fluid dispenser evenly saturates said absorbent material, wherein said cleaning roller rotates at a first speed in said cleaning fluid receiving position and at a second speed in said cleaning position, said first speed being less than said second speed.

6. A print media cleaning system comprising:

a sensor sensing a leading edge of a print media sheet, having a first length, as said print media sheet is transported along a sheet transport path;

a cleaning fluid dispenser;

a movable cleaning roller comprising an outside surface covered with an absorbent material; and a positioning device operatively connected to said cleaning roller, said positioning device moving said cleaning roller to a cleaning fluid receiving position immediately adjacent to said cleaning fluid dispenser, when in said cleaning fluid receiving position, said cleaning roller rotating so that cleaning fluid dispensed by said cleaning fluid dispenser evenly saturates said absorbent material, a predetermined time period after said leading edge is sensed by said sensor, said positioning device moving said cleaning roller to a cleaning position in contact with to said print media sheet, and when said cleaning roller is in said cleaning position, said cleaning roller rotating so as to clean a specific portion of said print media sheet, said specific portion having a second length that is less than said first length, wherein said cleaning roller rotates at a first speed in said cleaning fluid receiving position and at a second speed in said cleaning position, said first speed being less than said second speed.

7. The cleaning system of claim 6, said print media sheet comprising a flexible preprinted book cover and said specified portion comprising a spine section of said preprinted book cover, wherein cleaning, by said cleaning roller of said spine section, removes fuser oil from said spine section and ensures adequate adhesion during subsequent binding.

8. The cleaning system of claim 6, said cleaning roller being located on a first side of said sheet transport path, wherein, at a point of contact between said cleaning roller and said print media sheet on said first side, a direction of rotation of said cleaning roller is opposite a direction of travel of said print media sheet along said sheet transport path, and said cleaning system further comprising a backer roller located on a second side of said sheet transport path opposite said first side such that, when said cleaning roller is in said cleaning position, said cleaning roller and said backer roller form a cleaning nip through which said print media sheet passes, wherein, at a point of contact between said backer roller and said print media sheet on said second side, a direction of rotation of said backer roller is the same as said direction of travel of said print media sheet along said sheet transport path.

9. The cleaning system of claim 8, further comprising:

a cam follower having a first end, a second end opposite said first end, and a pivot point between said first end and said second end, wherein said cleaning roller is operatively connected to said cam follower at said second end;

a biasing member operatively connected to said cam follower at said first end;

an axle; and a positioning cam fixed to said axle and operatively connected to said cam follower adjacent to said biasing member, said positioning cam having a profile with a notch, during rotation of said axle, said profile of said positioning cam causing said cam follower to pivot about said pivot point moving said cleaning roller, and during rotation of said axle, said biasing member forcing said first end of said cam follower against said positioning cam until said notch is positioned above said axle adjacent to said first end and said cleaning roller is in said cleaning position and, when said notch is above said axle and said cleaning roller is in said cleaning position, said biasing member disengaging said first end of said cam follower from said positioning cam and forcing said cleaning roller against said backer roller.

10. The cleaning system of claim 6, said cleaning fluid dispenser comprising;

a cleaning fluid reservoir containing said cleaning fluid;

a wick in said cleaning fluid reservoir; and a cleaning fluid metering roller adjacent to said wick, said wick transferring said cleaning fluid to said cleaning fluid metering roller, when said cleaning roller is in said cleaning fluid receiving position, said cleaning roller rotating against said cleaning fluid metering roller and causing said cleaning fluid metering roller to rotate and evenly saturate said absorbent material on said cleaning roller, and when said cleaning roller is in said cleaning fluid receiving position, said cleaning fluid metering roller being biased against said cleaning roller with a resulting contact force between said cleaning fluid dispenser and said cleaning roller being selectively adjustable so that said absorbent material retains only a predetermined amount of said cleaning fluid.

11. A print media cleaning system comprising:

a retractable shutter blocking an opening in a sheet transport path guard guiding a print media sheet, having a first length, as said print media sheet is transported along a sheet transport path;

a sensor sensing a leading edge of said print media sheet;

a movable cleaning roller comprising an outside surface covered with an absorbent material, said absorbent material being essentially evenly saturated with a cleaning fluid; and a positioning device operatively connected to said cleaning roller and said shutter, a predetermined time period after said leading edge is sensed by said sensor, said positioning device essentially simultaneously moving said shutter away from said opening and moving said cleaning roller to a cleaning position in said opening in contact with said print media sheet, and when in said cleaning position, said cleaning roller rotating so as to clean a specific portion of said print media sheet with said cleaning fluid, said specific portion having a second length that is less than said first length.

12. The cleaning system of claim 11, said print media sheet comprising a flexible preprinted book cover and said specified portion comprising a spine section of said preprinted book cover, wherein cleaning, by said cleaning roller of said spine section, removes fuser oil from said spine section and ensures adequate adhesion during subsequent binding.

13. The cleaning system of claim 11, said cleaning roller being located on a first side of said sheet transport path, wherein, at a point of contact between said cleaning roller and said print media sheet on said first side, a direction of rotation of said cleaning roller is opposite a direction of travel of said print media sheet along said sheet transport path, and said cleaning system further comprising a backer roller located on a second side of said sheet transport path opposite said first side such that, when said cleaning roller is in said cleaning position, said cleaning roller and said backer roller form a cleaning nip through which said print media sheet passes, wherein, at a point of contact between said backer roller and said print media sheet on said second side, a direction of rotation of said backer roller is the same as said direction of travel of said print media sheet along said sheet transport path.

14. The cleaning system of claim 13, said positioning device comprising:

a cam follower having a first end, a second end opposite said first end, and a pivot point between said first end and said second end, wherein said cleaning roller is operatively connected to said cam follower at said second end;

a biasing member operatively connected to said cam follower at said first end;

an axle;

a positioning cam fixed to said axle and operatively connected to said cam follower adjacent to said biasing member;

an additional positioning cam fixed to said axle; and an additional cam follower operatively connected between said additional positioning cam and said shutter, said positioning cam having a profile with a notch, during rotation of said axle, said profile of said positioning cam causing said cam follower to pivot about said pivot point moving said cleaning roller, during rotation of said axle, said biasing member forcing said first end of said cam follower against said positioning cam until said notch is positioned above said axle adjacent to said first end and said cleaning roller is in said cleaning position and, when said notch is above said axle and said cleaning roller is in said cleaning position, said biasing member disengaging said first end of said cam follower from said positioning cam and forcing said cleaning roller against said backer roller, and during rotation of said axle as said cleaning roller moves into said cleaning position, said additional positioning cam rotating against said additional cam follower and causing said additional cam follower to move said shutter away from said opening.

15. The cleaning system of claim 11, further comprising a cleaning fluid dispenser, before moving said cleaning roller into said cleaning position, said positioning device moving said cleaning roller to a cleaning fluid receiving position immediately adjacent to said cleaning fluid dispenser, and when in said cleaning fluid receiving position, said cleaning roller rotating so that cleaning fluid dispensed by said cleaning fluid dispenser evenly saturates said absorbent material, wherein said cleaning roller rotates at a first speed in said cleaning fluid receiving position and at a second speed in said cleaning position, said first speed being less than said second speed.

16. A print media cleaning method comprising:

sensing a leading edge of a print media sheet, having a first length, as said print media sheet is transported along a sheet transport path;

a predetermined time period after said leading edge is sensed, moving a cleaning roller to a cleaning position in contact with said print media sheet, said cleaning roller comprising an outside surface covered with an absorbent material essentially evenly saturated with a cleaning fluid; and when said cleaning roller is in said cleaning position, rotating said cleaning roller in order to clean a specific portion of said print media sheet with said cleaning fluid, said specific portion having a second length that is less than said first length.

17. The method of claim 16, said rotating of said cleaning roller, when said cleaning roller is in said cleaning position, further comprising rotating said cleaning roller such that, at a point of contact between said cleaning roller and said print media sheet on a said first side of said sheet transport path, a direction of rotation of said cleaning roller is opposite a direction of travel of said print media sheet along said sheet transport path, and said method further comprising rotating a backer roller, which is located on a second side of said sheet transport path opposite said first side such that, at a point of contact between said backer roller and said print media sheet on said second side, a direction of rotation of said backer roller is the same as said direction of travel of said print media sheet, wherein said backer roller is positioned opposite said cleaning roller, when said cleaning roller is in said cleaning position, and forms a cleaning nip through which said print media sheet passes.

18. The method of claim 17, further comprising, when said cleaning roller is in said cleaning position, biasing said cleaning roller against said backer roller.

19. The method of claim 16, said print media sheet comprising a preprinted book cover and said specified portion comprising a spine section of said preprinted book cover, wherein cleaning, by said cleaning roller of said spine section, removes fuser oil from said spine section and ensures adequate adhesion during subsequent binding.

20. The method of claim 16, further comprising, before moving said cleaning roller into said cleaning position, moving said cleaning roller to a cleaning fluid receiving position immediately adjacent to a cleaning fluid dispenser, when said cleaning roller is in said cleaning fluid receiving position, rotating said cleaning roller so that cleaning fluid dispensed by a cleaning fluid metering roller of said cleaning fluid dispenser evenly saturates said absorbent material, wherein said cleaning roller is rotated at a first speed in said cleaning fluid receiving position and at a second speed in said cleaning position, said first speed being less than said second speed, and when said cleaning roller is in said cleaning fluid receiving position, further selectively adjusting a contact force between said cleaning roller and said cleaning fluid metering roller to ensure that said absorbent material retains only a predetermined amount of said cleaning fluid.

21. The method of claim 16, further comprising, during said moving of said cleaning roller into said cleaning position, essentially simultaneously retracting a shutter blocking an opening in a sheet transport path guard so that said cleaning roller can move through said opening and into said cleaning position.

* * * * *